US010927828B2

(12) United States Patent
Kim et al.

(10) Patent No.: US 10,927,828 B2
(45) Date of Patent: Feb. 23, 2021

(54) LINEAR COMPRESSOR HAVING DISCHARGE VALVE, SUPPORT WITH ROTATION PREVENTION PROTRUSIONS, AND DISCHARGE COVER WITH PROTRUSION ACCOMMODATION GROOVES

(71) Applicant: LG ELECTRONICS INC., Seoul (KR)

(72) Inventors: Junghae Kim, Seoul (KR); Jeehyun Kim, Seoul (KR); Kiwon Noh, Seoul (KR); Yunhyeok Yu, Seoul (KR); Kyungmin Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 771 days.

(21) Appl. No.: 15/496,261

(22) Filed: Apr. 25, 2017

(65) Prior Publication Data

US 2017/0321677 A1 Nov. 9, 2017

(30) Foreign Application Priority Data

May 3, 2016 (KR) ..... 10-2016-0054897

(51) Int. Cl.
*F04B 39/10* (2006.01)
*F04B 35/04* (2006.01)
(Continued)

(52) U.S. Cl.
CPC ..... *F04B 39/102* (2013.01); *F04B 35/04* (2013.01); *F04B 35/045* (2013.01); *F04B 39/10* (2013.01);
(Continued)

(58) Field of Classification Search
CPC ..... F04B 39/10; F04B 17/042; F04B 17/044; F04B 17/04; F04B 53/1032;
(Continued)

(56) References Cited

U.S. PATENT DOCUMENTS 5,022,832 A 6/1991 Lauterbach et al.
6,209,328 B1 * 4/2001 Kim ..... F04B 35/045 310/13
(Continued)

FOREIGN PATENT DOCUMENTS

CN 101835978 9/2010
CN 104251192 12/2014
(Continued)

OTHER PUBLICATIONS

Chinese Office Action dated Jul. 31, 2018.
(Continued)

*Primary Examiner* — Peter J Bertheaud
(74) *Attorney, Agent, or Firm* — Ked & Associates LLP

(57) ABSTRACT

A linear compressor is provided that may include a shell, a cylinder accommodated into the shell and defining a compression space for a refrigerant, a frame to which the cylinder may be fixed, a piston that reciprocates within the cylinder in an axial direction and compresses a refrigerant supplied to the compression space, a discharge valve that discharges the refrigerant compressed in the compression space, a discharge cover coupled to the frame and defining a discharge space in which the refrigerant discharged from the compression space by opening of the discharge valve may be collected, a valve spring that supports the discharge valve, and a support integrally formed with the valve spring by insert injection molding and coupled to the discharge cover. The valve spring may define one or more holes filled
(Continued)

with a molding liquid used to form the support in the insert injection molding of the support.

12 Claims, 11 Drawing Sheets

(51) Int. Cl.
*F04B 39/12* (2006.01)
*F04B 53/00* (2006.01)

(52) U.S. Cl.
CPC ..... *F04B 39/1033* (2013.01); *F04B 39/121* (2013.01); *F04B 39/122* (2013.01); *F04B 39/125* (2013.01); *F04B 53/001* (2013.01)

(58) Field of Classification Search
CPC .. F04B 39/1033; F04B 35/045; F04B 53/001; F04B 35/04; F04B 39/125; F04B 39/121; F04B 39/123; F04B 39/102; F04B 39/122; F04B 39/126; F04B 17/03; F04B 19/22; Y10T 137/7936; Y10T 137/7922
USPC ..... 417/417
See application file for complete search history.

(56) References Cited

U.S. PATENT DOCUMENTS

| | | | | |
|---|---|---|---|---|
| 6,554,201 | B2 * | 4/2003 | Klimowicz | A61M 11/005 239/102.1 |
| 2002/0162898 | A1 | 11/2002 | Klimowicz et al. | |
| 2009/0220365 | A1 * | 9/2009 | Kang | F04B 39/102 417/570 |
| 2009/0277166 | A1 | 11/2009 | Walz | |
| 2015/0004025 | A1 * | 1/2015 | Kang | F04B 49/225 417/415 |
| 2016/0017875 | A1 * | 1/2016 | Noh | F04B 39/102 417/443 |
| 2016/0017876 | A1 | 1/2016 | Kim et al. | |

FOREIGN PATENT DOCUMENTS

| | | |
|---|---|---|
| CN | 105298802 | 2/2016 |
| KR | 10-2016-0010999 | 1/2016 |
| KR | 10-2016-0011007 | 1/2016 |

OTHER PUBLICATIONS

European Search Report dated Oct. 17, 2017.
Korean Office Action dated Oct. 23, 2020 issued in Application No. 10-2016-0054897.

* cited by examiner

LINEAR COMPRESSOR HAVING DISCHARGE VALVE, SUPPORT WITH ROTATION PREVENTION PROTRUSIONS, AND DISCHARGE COVER WITH PROTRUSION ACCOMMODATION GROOVES

CROSS-REFERENCE TO RELATED APPLICATION(S)

The present application claims the benefits of priority to Korean Patent Application No. 10-2016-0054897, filed in Korea on May 3, 2016, which is herein incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this, the cooling system includes a compressor, a condenser, an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases, thereby increasing pressure. Compressors are being widely used in home appliances or industrial fields.

Compressors may be largely classified into reciprocating compressors, in which a compression space into/from which a working gas is suctioned and discharged, is defined between a piston and a cylinder to allow the piston to be linearly reciprocated into the cylinder, thereby compressing a refrigerant, rotary compressors, in which a compression space into/from which a working gas is suctioned or discharged, is defined between a roller that eccentrically rotates and a cylinder to allow the roller to eccentrically rotate along an inner wall of the cylinder, thereby compressing a refrigerant, and scroll compressors, in which a compression space into/from which a refrigerant is suctioned or discharged, is defined between an orbiting scroll and a fixed scroll to compress a refrigerant while the orbiting scroll rotates along the fixed scroll.

In recent years, a linear compressor, which is directly connected to a linear motor, in which a piston linearly reciprocates, to improve compression efficiency without mechanical losses due to moving direction conversion, and having a simple structure, is being widely developed.

In general, the linear compressor may suction and compress a refrigerant while a piston linearly reciprocates in a sealed shell by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

Korean Patent Publication No. 10-2016-0011008, published on Jan. 29, 2016 (hereinafter, referred to as "prior art document", which is hereby incorporated by reference, discloses a linear compressor. The linear compressor includes a shell with a discharge part or outlet; a cylinder disposed inside of the shell to define a compression space for a refrigerant; a frame that fixes the cylinder to the shell; a piston that reciprocates within the cylinder in an axial direction; a discharge valve disposed on one side of the cylinder to selectively discharge a refrigerant compressed in the compression space; a discharge cover coupled to the frame and having a resonance chamber that reduces a pulsatory motion of the refrigerant discharged through the discharge valve; a valve spring disposed in the discharge cover to provide a restoring force to the discharge valve; and a stopper coupled to the valve spring to restrict deformation of the valve spring.

According to the prior art document, the stopper may be insert-injection-molded along an outer side of the valve spring. However, even when the stopper is insert-injection-molded with the valve spring, the valve spring may be relatively rotated with respect to the stopper.

Also, as a portion of the stopper is disposed in front of the valve spring, movement of the discharge valve may be limited when the discharge valve moves. However, a central portion of the valve spring to which the discharge valve is coupled may collide with the stopper and generate collision noise.

BRIEF DESCRIPTION OF THE DRAWINGS

Embodiments will be described in detail with reference to the following drawings in which like reference numerals refer to like elements, and wherein.

DETAILED DESCRIPTION

Figure 1:
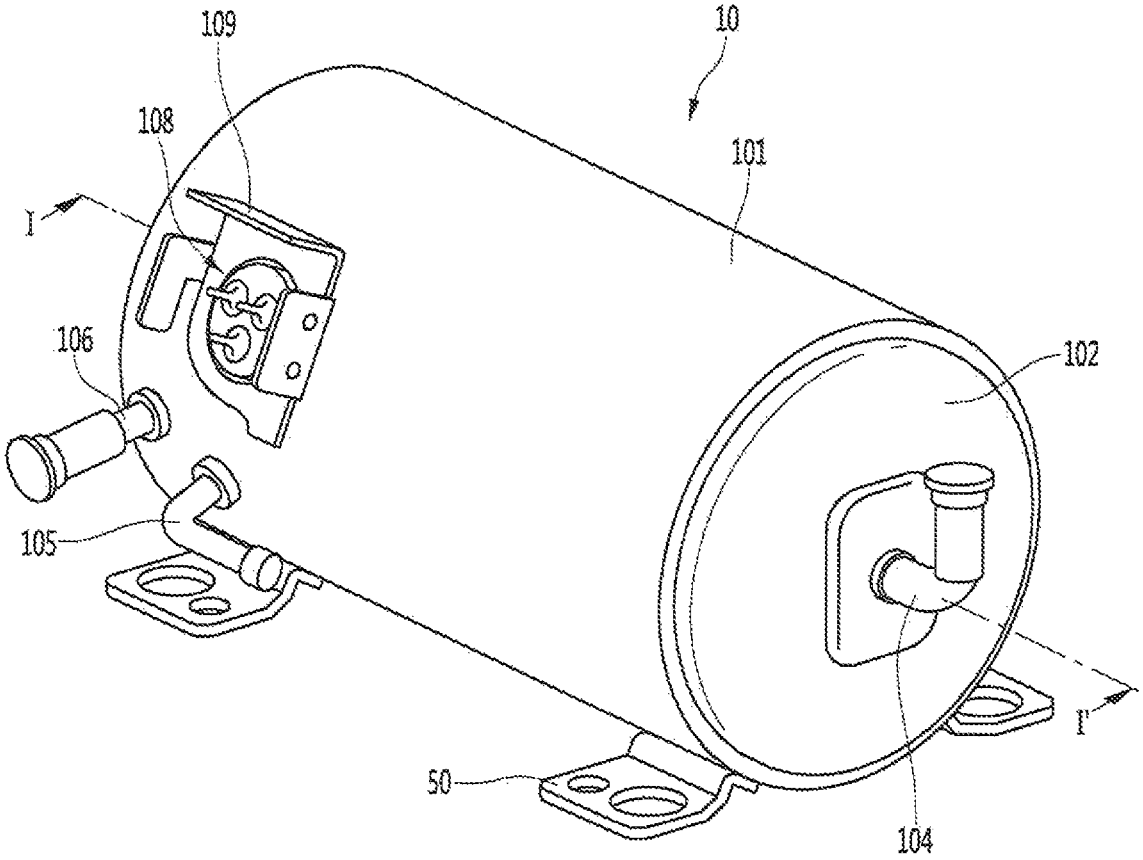
FIG. 1 is a perspective view illustrating an outer appearance of a linear compressor according to an embodiment.

Hereinafter, embodiments will be described in detail with reference to the accompanying drawings. Where possible, like reference numerals have been used to indicate like elements, and repetitive disclosure has been omitted.

Figure 2:
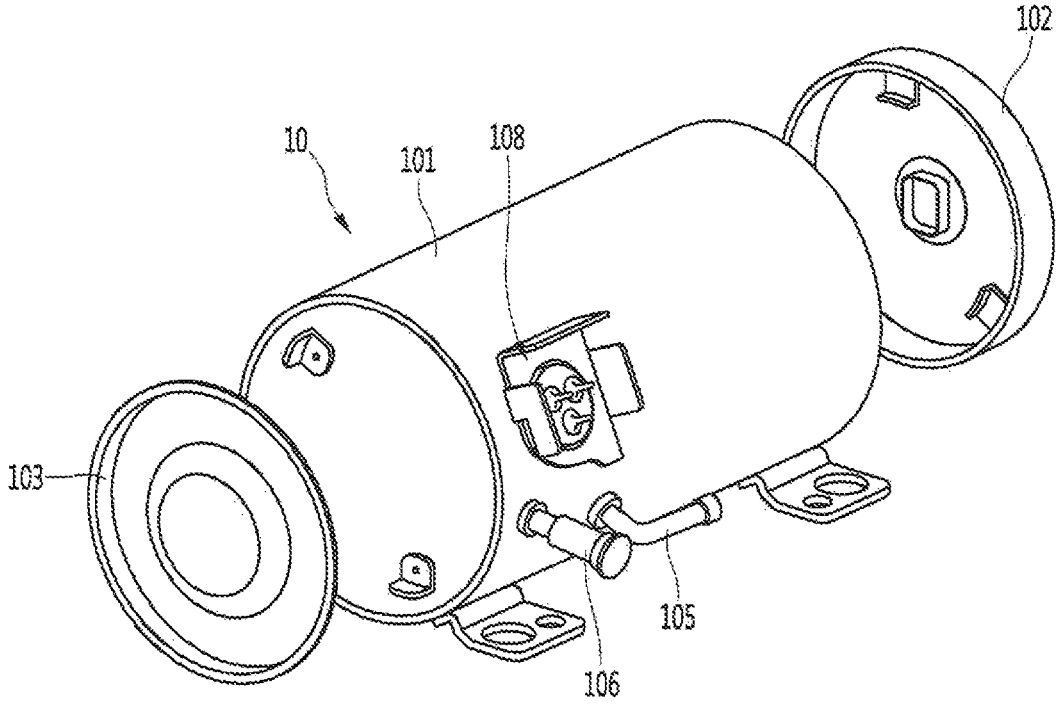
FIG. 2 is an exploded perspective view of a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may transmit external power to a motor (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both ends of the shell 101 may be open. The shell covers 102 and 103 may be coupled to the open ends of the shell 101, respectively. The shell covers 102 and 103 may include a first shell cover 102 coupled to one or a first open end of the shell 101 and a second shell cover 103 coupled to the other or a second open end of the shell 101. An inner space of the shell 101 may be sealed by the shell covers 102 and 103.

In FIG. 1, the first shell cover 102 may be disposed or provided at a right or first end of the linear compressor 10, and the second shell cover 103 may be disposed or provided at a left or second end of the linear compressor 10. In other words, the first and second shell covers 102 and 103 may be disposed to face each other.

The linear compressor 10 may further include a plurality of pipes 104, 105, and 106 provided to suction, discharge, or inject the refrigerant, and the plurality of pipes 104, 105, and 106 may be provided in the shell 101 or the shell covers 102 and 103 The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe 106 through which the refrigerant may be supplemented to the linear compressor 10. For example, the suction pipe 104 may be coupled to the first shell cover 102. The refrigerant may be suctioned into the linear compressor 10 through the suction pipe 104 in an axial direction.

The discharge pipe 105 may be coupled to the shell 101. The refrigerant suctioned through the suction pipe 104 may be compressed while flowing in the axial direction of the shell 101. The compressed refrigerant may be discharged through the discharge pipe 105. The discharge pipe 105 may be disposed or provided at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

Figure 3:
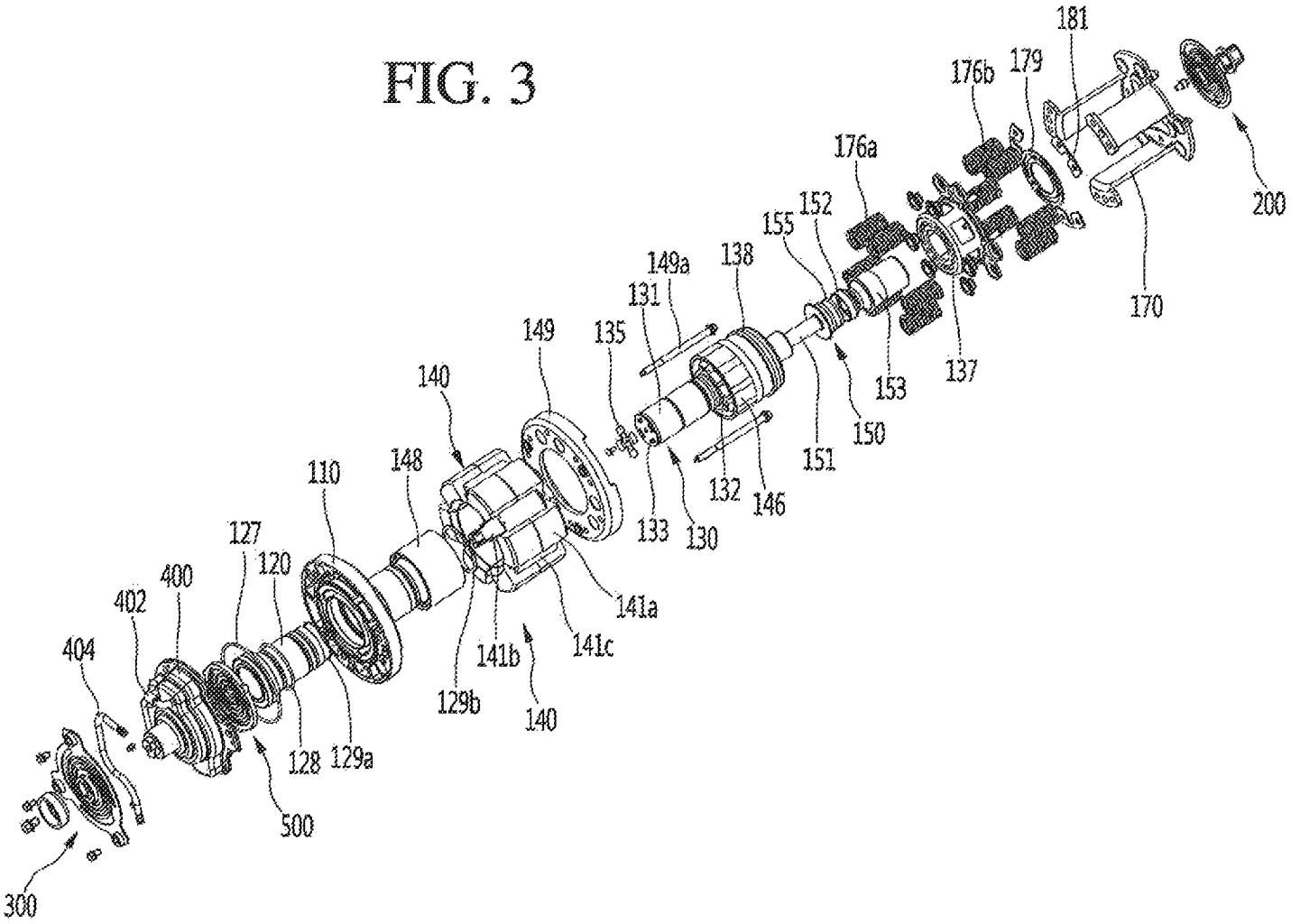
FIG. 3 is an exploded perspective view illustrating internal parts or components of the linear compressor according to an embodiment.
Figure 4:
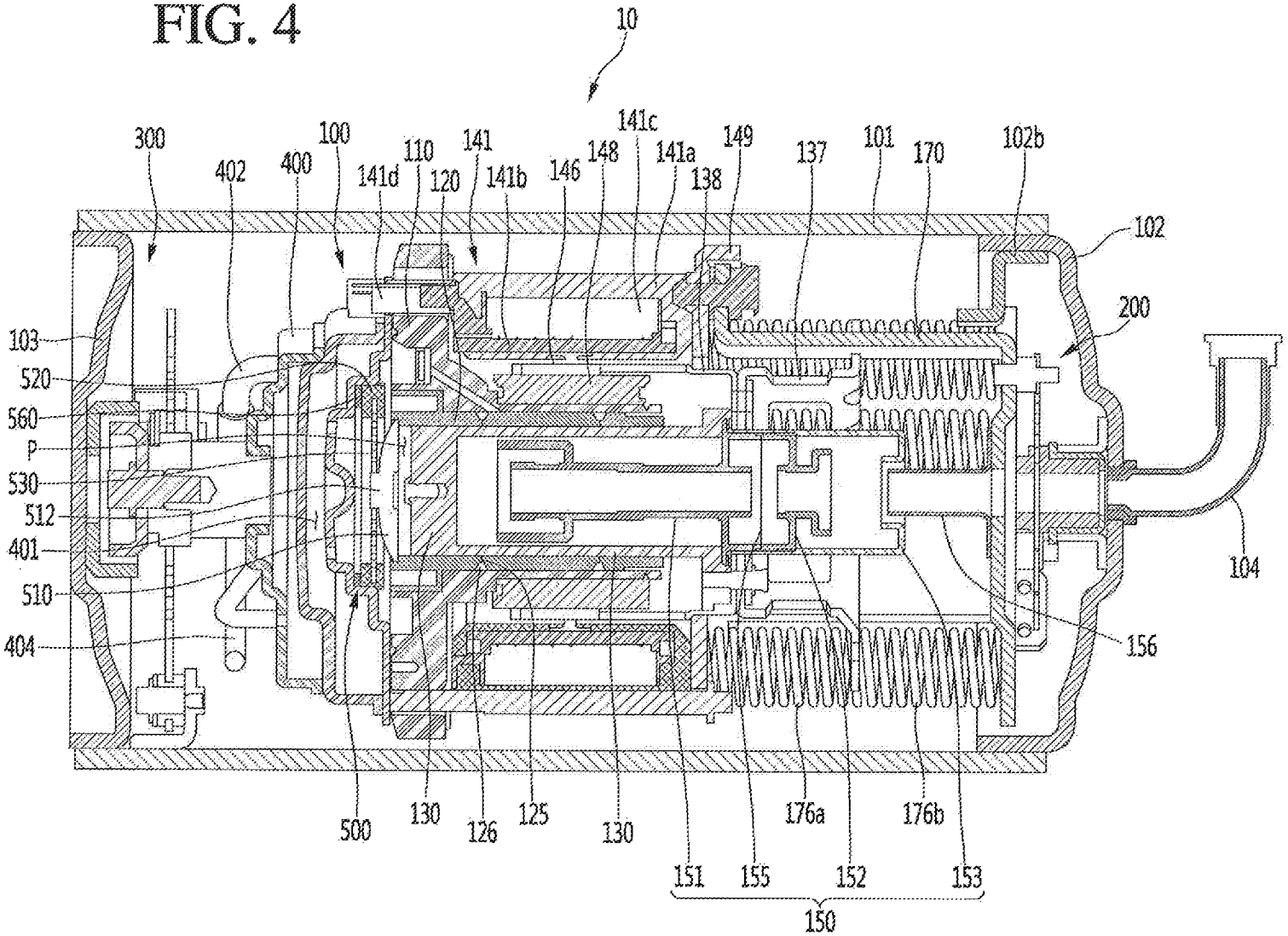
FIG. 4 is a cross-sectional view, taken along line I-I' of FIG. 1.

FIG. 3 is an exploded perspective view illustrating internal parts of the linear compressor according to an embodiment. FIG. 4 is a cross-sectional view taken along line I-I' of FIG. 1.

Referring to FIGS. 3 and 4, the linear compressor 10 according to an embodiment may include a compressor body 100 and a plurality of support devices or supports that supports the compressor body 100 to one or more of the shell 101 and the shell covers 102 and 103. The compressor body may include a cylinder 120 provided in the shell 101, a piston 130 that linearly reciprocates within the cylinder 120, and a motor 140 that applies a drive force to the piston 130. The motor 140 may include a linear motor. Therefore, when the motor 140 is driven, the piston 130 may reciprocate in the axial direction of the shell 101.

The compressor body 100 may further include a suction muffler 150. The suction muffler 150 may be coupled to the piston 130 to reduce a noise generated from the refrigerant suctioned through the suction pipe 104. The refrigerant suctioned through the suction pipe 104 may flow into the piston 130 via the suction muffler 150. For example, while the refrigerant passes through the suction muffler 150, a flow noise of the refrigerant may be reduced.

The suction muffler 150 may include a plurality of mufflers 151, 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" defined herein may be a central axis or central longitudinal axis direction of the shell 101 and may be understood as a direction (horizontal direction of FIG. 4) in which the piston 130 reciprocates. Also, in the "axial direction", a direction from the suction pipe 104 toward a compression space P, that is, a direction in which the refrigerant flows may be defined as a "frontward direction", and a direction opposite to the frontward direction may be defined as a "rearward direction". On the other hand, the "radial direction" may be understood as a direction which is perpendicular to the radial direction of the shell 101 or the direction (vertical direction of FIG. 4) in which the piston 130 reciprocates. The "axis of the compressor body" means the central line in the axial direction of the piston 130 or the central axis of the shell 101.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover assembly 400 and a discharge valve assembly 500 may be provided in or at a front side of the compression space P. The discharge cover assembly 400 may define a discharge space 401 for a refrigerant discharged from the compression space P. The discharge valve assembly 500 may be coupled to the discharge cover assembly 400 to selectively discharge the refrigerant compressed in the compression space P. The discharge space 401 may include a plurality of space parts or spaces partitioned by inner walls of the discharge cover assembly 400. The plurality of space parts may be disposed or provided in the front and rear direction to communicate with each other.

The discharge valve assembly 500 may include a discharge valve 510 and a spring assembly 520. The discharge valve 510 may be opened when a pressure of the compression space P is above a discharge pressure to introduce the refrigerant into the discharge space 401 of the discharge cover assembly 400. The spring assembly 520 may be disposed or provided between the discharge valve 510 and the discharge cover 400 to provide an elastic force in the axial direction. The spring assembly 520 will be described hereinafter with reference to the accompanying drawings.

A rear portion or a rear surface of the discharge valve 510 may be supported at a front surface of the cylinder 120. When the discharge valve 510 is supported on or at the front surface of the cylinder 120, the compression space P may be maintained in a sealed state. In contrast, when the discharge valve 510 is spaced apart from the front surface of the cylinder 120, the compression space P may be opened to discharge the refrigerant compressed in the compression space P.

The compression space P is a space defined between the suction valve 135 and the discharge valve 510. The suction valve 135 may be disposed or provided on one or a first side of the compression space P, and the discharge valve 510 may be disposed or provided on the other or a second side of the compression space P, that is, an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

The discharge valve 510 may be opened when the pressure of the compression space P is above the discharge pressure, and the refrigerant discharged from the compression space P to the discharge space 401 of the discharge cover assembly 400. When the discharge of the refrigerant is completed, the discharge valve 510 may be closed by a restoring force of the spring.

The compressor body 100 may further include a cover pipe 402. The cover pipe 402 may be coupled to the discharge cover assembly 400 to discharge the refrigerant flowing through the discharge space 401 of the discharge cover assembly 400.

The compressor body 100 may further include a loop pipe 404. The loop pipe 404 may be coupled to the cover pipe 402 to move the refrigerant flowing through the cover pipe 402 to the discharge pipe 105. The loop pipe 404 may have one or a first end coupled to the cover pipe 402 and the other or a second end coupled to the discharge pipe 105.

The loop pipe 404 may include a flexible material. The loop pipe 404 may roundly extend from the cover pipe 402 along the inner circumferential surface of the shell 101 and be coupled to the discharge pipe 105. For example, the loop pipe 404 may have a wound shape.

The compressor body 100 may further include a frame 110. The frame 110 may be configured to fix the cylinder 120. For example, the cylinder 120 may be press-fitted into the frame 110.

The frame 110 may be disposed or provided to surround the cylinder 120. That is, the cylinder 120 may be accommodated in the frame 110. The discharge cover 160 may be coupled to a front surface of the frame 110 using a coupling member.

The compressor body 100 may further include a motor 140. The motor 140 may include an outer stator 141 fixed to the frame 110 and disposed or provided to surround the cylinder 120, an inner stator 148 disposed or provided to be spaced inward from the outer stator 141, and a permanent magnet 146 disposed or provided in a space between the outer stator 141 and the inner stator 148.

The permanent magnet 146 may linearly reciprocate by a mutual electromagnetic force between the outer stator 141 and the inner stator 148. The permanent magnet 146 may be provided as a single magnet having one polarity or by coupling a plurality of magnets having three polarities to each other.

A magnet frame 138 may be installed or provided on the permanent magnet 146. The magnet frame 138 may have an approximately cylindrical shape and be inserted into the space between the outer stator 141 and the inner stator 148.

Referring to the cross-sectional view of FIG. 4, the magnet frame 138 may be coupled to the piston flange 132 to extend in an outer radial direction and then be bent forward. The permanent magnet 146 may be installed or provided on or at a front end of the magnet frame 138. When the permanent magnet 146 reciprocates, the piston 130 may reciprocate together with the permanent magnet 146 in the axial direction.

The outer stator 141 may include coil winding bodies 141*b*, 141*c*, and 141*d* and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141.

The stator core 141*a* may include a plurality of core blocks in which a plurality of laminations may be laminated in a circumferential direction. The plurality of core blocks may be disposed or provided to surround at least a portion of the coil winding bodies 141*b* and 141*c*.

A stator cover 149 may be disposed or provided on one or a first side of the outer stator 141. That is, the outer stator 141 may have one or a first side supported by the frame 110 and the other or a second side supported by the stator cover 149.

The linear compressor 10 may further include a cover coupling member 149*a* that couples the stator cover 149 to the frame 110. The cover coupling member 149*a* may pass through the stator cover 149 to extend forward to the frame 110 and then be coupled to the frame 110.

The inner stator 148 may be fixed to an outer circumference of the frame 110. In the inner stator 148, the plurality of laminations may be laminated in the circumferential direction outside of the frame 110.

The compressor body 100 may further include a support 137 that supports the piston 130. The support 137 may be coupled to a rear portion of the piston 130, and the muffler 150 may be disposed or provided to pass through the inside of the support 137. The piston flange 132, the magnet frame 138, and the support 137 may be coupled to each other using a coupling member.

A balance weight 179 may be coupled to the support 137. A weight of the balance weight 179 may be determined based on a drive frequency range of the compressor body 100.

The compressor body 100 may further include a back cover 170 coupled to the stator cover 149 and extending rearward. The back cover 170 may include three support legs; however, embodiments are not limited thereto. The three support legs may be coupled to a rear surface of the stator cover 149. A spacer 181 may be disposed or provided between the three support legs and the rear surface of the stator cover 149. A distance from the stator cover 149 to a rear end of the back cover 170 may be determined by adjusting a thickness of the spacer 181. The back cover 170 may be spring-supported by the support 137.

The compressor body 100 may further include an inflow guide part or guide 156 coupled to the back cover 170 to guide the inflow of the refrigerant into the muffler 150. At least a portion of the inflow guide part 156 may be inserted into the suction muffler 150.

The compressor body 100 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the back cover 170. The piston 130 which reciprocates within the linear compressor 10 may stably move by the action of the plurality of resonant springs 176*a* and 176*b* to reduce vibration or noise due to movement of the piston.

The compressor body 100 may further include a plurality of sealing members or seals 127 and 128 that increase a coupling force between the frame 110 and peripheral parts or components around the frame 110. The plurality of sealing members 127 and 128 may include a first sealing member or seal 127 disposed or provided at a portion at which the frame 110 and the discharge cover 160 are coupled to each other. The plurality of sealing members 127 and 128 may further include a second sealing member or seal 128 disposed or provided at a portion at which the frame 110 and the discharge cover 160 are coupled to each other. Each of the first and second sealing members 127 and 128 may have a ring shape.

The plurality of support devices 200 and 300 may include a first support device or support 200 coupled to one or a first side of the compressor body 100 and a second support device or support 300 coupled to the other or a second side of the compressor body 100. The first support device 200 may be fixed to the first shell cover 102, and the second support device 300 may be fixed to the shell 101.

Figure 5:
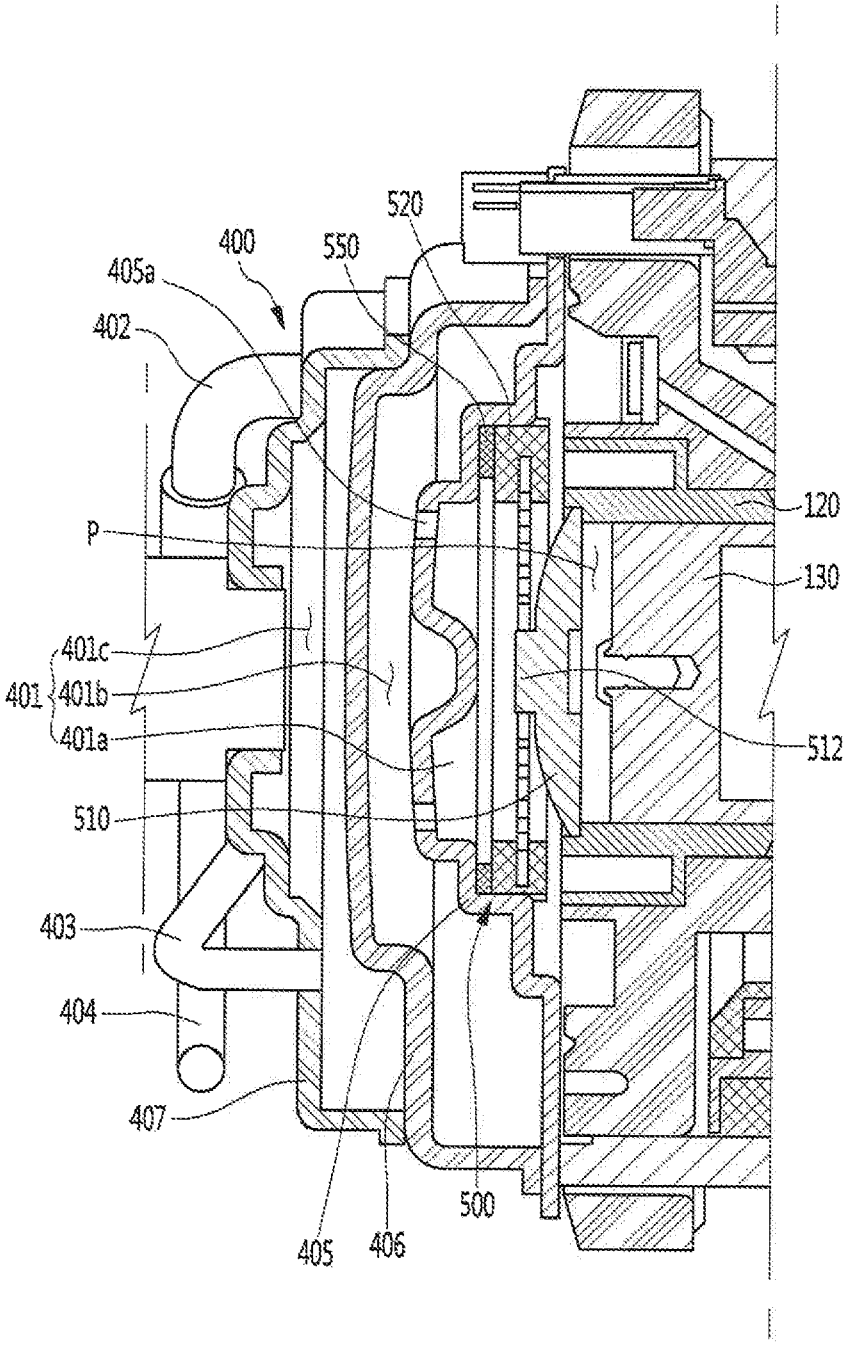
FIG. 5 is a cross-sectional view illustrating a state in which a discharge valve assembly is coupled to a discharge cover according to an embodiment.
Figure 6:
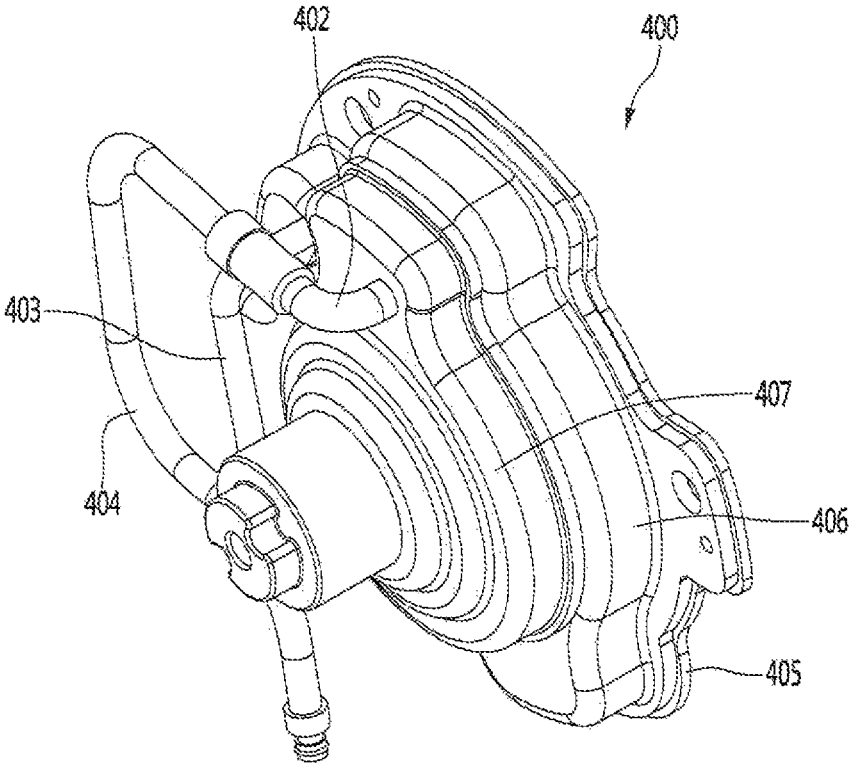
FIG. 6 is a perspective view of a discharge cover according to an embodiment.

FIG. 5 is a cross-sectional view illustrating a state in which a discharge valve assembly is coupled to a discharge cover according to an embodiment. FIG. 6 is a perspective view of the discharge cover according to an embodiment. and FIG. 7 is a cross-sectional view illustrating a state in which the discharge valve assembly is coupled to the discharge cover according to an embodiment.

Figure 7:
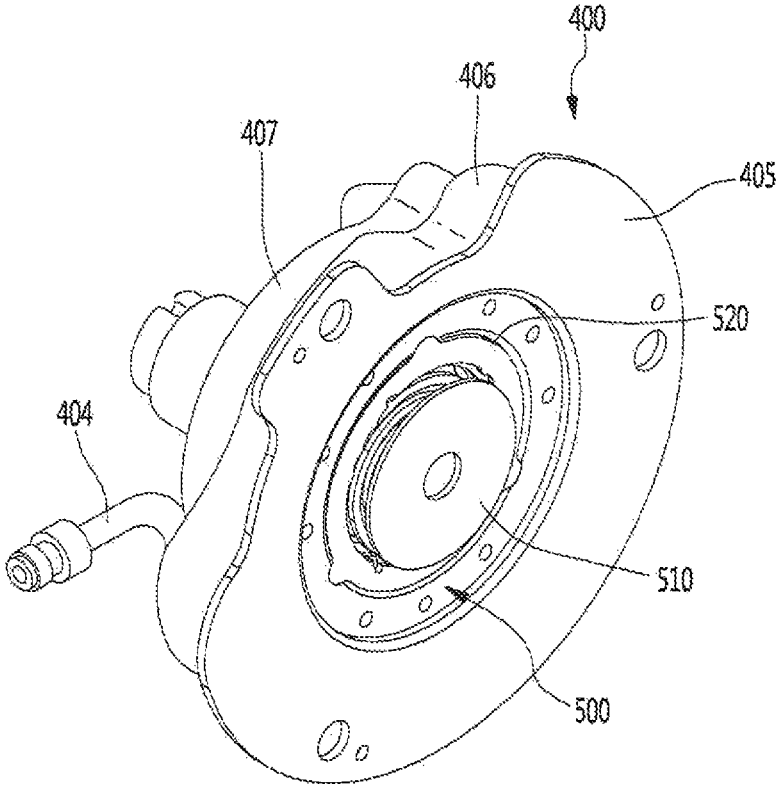
FIG. 7 is a cross-sectional view illustrating a state in which a discharge valve assembly is coupled to a discharge cover according to an embodiment.

Referring to FIGS. 5 to 7, the discharge cover assembly 400 may include a discharge cover 405 that accommodates the discharge valve assembly 500, a first discharge muffler 406 that covers the discharge cover 405, and a second discharge muffler 407 that covers the first discharge muffler 406. A plurality of discharge spaces 401 may be defined by the discharge cover assembly 400, and the plurality of discharge spaces 401 may include three space parts or spaces. A number of space parts or spaces may be changed according to a number of the discharge mufflers. The three space parts may include a first space part or space 401*a*, a second space part or space 401*b*, and a third space part or space 401*c*.

The refrigerant discharged from the compression space P may flow into the first space part 401*a*. The refrigerant flowing into the first space part 401*a* may be moved to the second space part 401*b* through a discharge hole 405*a* defined in the discharge cover 405. While the refrigerant is moved from the first space part 401*a* to the second space part 401*b* through the discharge hole 405*a*, vibration and noise by pulsation may be primarily reduced. The refrigerant moved to the second space part 401*b* may be moved to the third space part 401*c* through a connection pipe 403. The connection pipe 403 may be a refrigerant pipe that connects the first discharge muffler 406 to the second discharge muffler 407. While the refrigerant flows to the third space part 401*c* along the connection pipe 403, vibration and noise may be secondarily reduced. As such, a noise reduction effect increases as a space to which the refrigerant discharged from the compression space P moves increases. On the other hand, the refrigerant moved to the third space part 401*c* may be discharged to the outside of the compressor through a cover pipe 402 and a loop pipe 404.

The discharge cover assembly 400 may be coupled to the frame 110 in a state in which the discharge valve assembly 500 is located at the first space part 401*a* of the discharge cover assembly 400.

Figure 8:
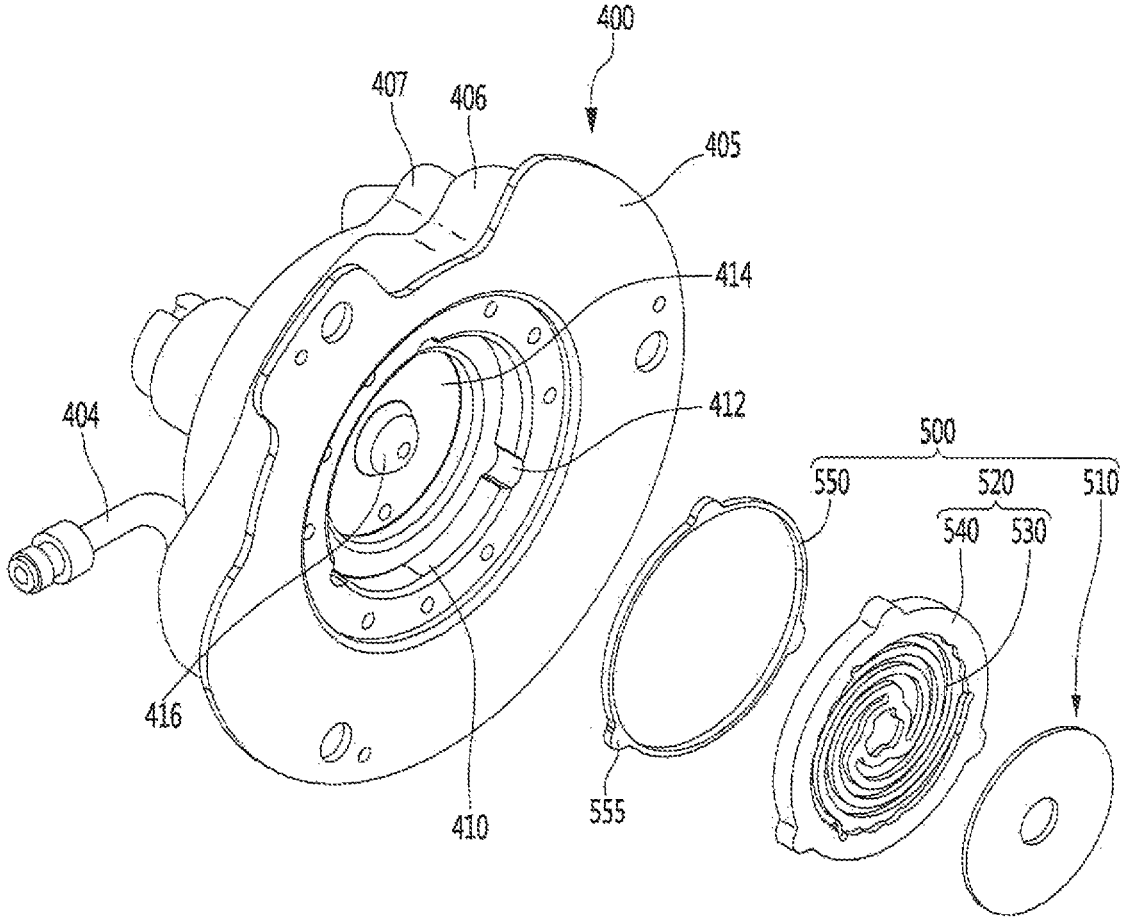
FIG. 8 is an exploded perspective view of a discharge valve assembly according to an embodiment.
Figure 9:
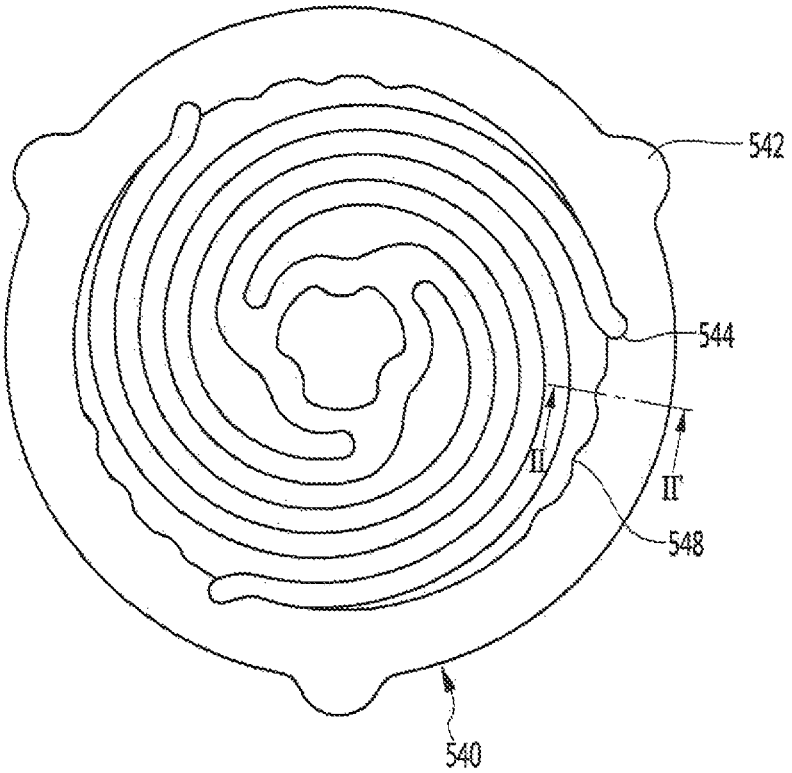
FIG. 9 is a front view of a spring assembly according to an embodiment.
Figure 10:
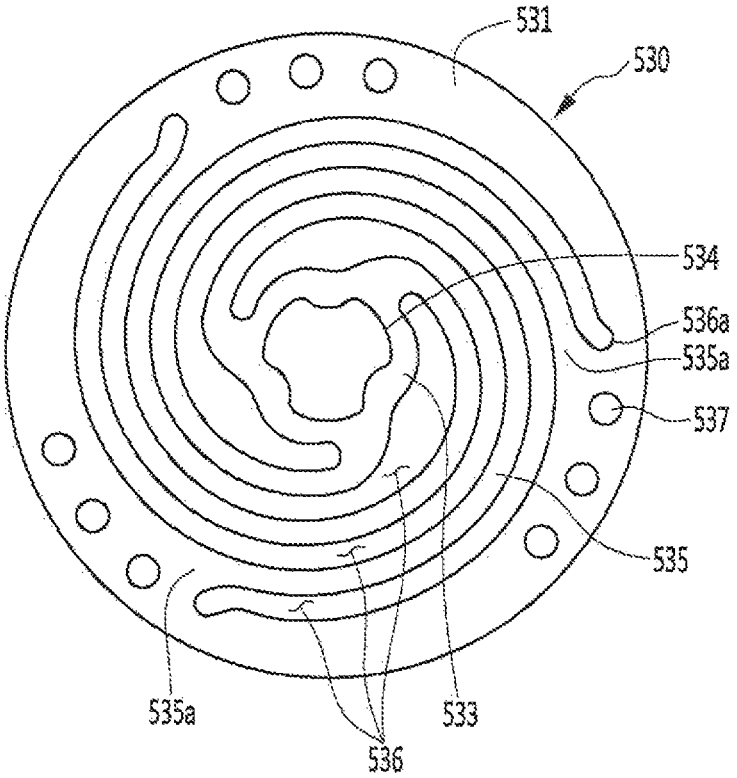
FIG. 10 is a front view of a valve spring according to an embodiment.
Figure 11:
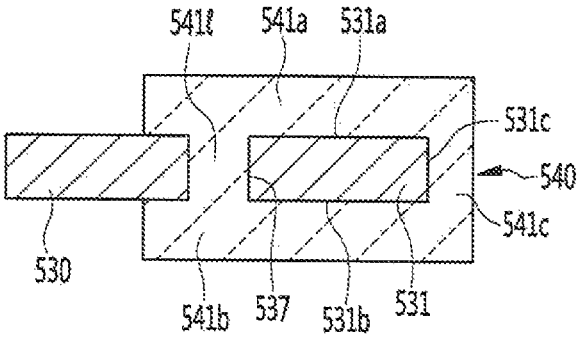
FIG. 11 is a cross-sectional view taken along line II-II' of FIG. 9.

FIG. 8 is an exploded perspective view of a discharge valve assembly according to an embodiment. FIG. 9 is a front view of a spring assembly according to an embodiment. FIG. 10 is a front view of a valve spring according to an embodiment. FIG. 11 is a cross-sectional view taken along line II-II' of FIG. 9.

Referring to FIGS. 5 and 8 to 11, discharge valve assembly 500 according to an embodiment may include discharge valve 510, spring assembly 520 that supports the discharge valve 510, and a ring-shaped gasket 550 disposed at a front edge of the spring assembly 520.

The spring assembly 520 may include a valve spring 530 to which the discharge valve 510 may be coupled, and a support 540 that supports the valve spring 530. As shown in FIG. 10, the valve spring 530 may be a plate spring. The valve spring 530 may include an outer rim 531, an inner rim 533 disposed or provided in an inner region of the outer rim 531, and a connection part or portion 535 that connects the outer rim 531 to the inner rim 533. For example, a plurality of connection parts 535 may extend in a spiral shape and connect the outer rim 531 to the inner rim 533.

As the plurality of connection parts 535 are disposed or provided spaced apart from each other, a plurality of elastic slots 536 may be defined between the plurality of connection parts 535. A stress concentration reduction slot 536*a* that reduces a stress concentration may be defined at an outer end of each of the plurality of elastic slots 536.

The stress concentration reduction slot 536*a* may be defined at a point at which each of the plurality of connection parts 535 starts to extend from an inner circumferential surface of the outer rim 531. Also, the stress concentration reduction slot 536*a* may extend to be bent in a direction far away from the inner rim 533 (or a radial direction of the valve spring 530) at an outer end of the elastic slot 536.

The support 540 may be integrally formed with the valve spring 530 by insert injection molding, for example. For example, the support 540 may be insert-injection-coupled to the valve spring 530 such that the support 540 surrounds the outer rim 531.

More specifically, the support 540 may include a first portion 541*a* that comes into contact with or contacts a first surface 531*a* of the outer rim 531, a second portion 541*b* that comes into contact with or contacts a second surface 531*b* which is opposite to the first surface 531*a* of the outer rim 531, a third portion 541*c* that connects the first portion 541*a* to the second portion 541*b* and comes into contact with or contacts an outer circumferential surface of the outer rim 531, and a hole filling portion 541*d*, which will be described hereinafter.

A slot 544 having a same shape as the stress concentration reduction slot 536*a* may be defined in the support 540 so as to prevent the support 540 from clogging the stress concentration reduction slot 536*a*.

One or more holes 537 may be defined in the outer rim 531 so as to prevent the relative rotation between the valve spring 530 and the support 540 in a state in which the support 540 is insert-injection-molded to the valve spring 530. In the process of insert-injection-molding the support 540 to the valve spring 530, a molding liquid for forming the support 540 may fill the hole 537 to define the hole filling portion 541*d*.

Therefore, after the support 540 is insert-injection-molded to the valve spring 530, the hole filling portion 541*d* filling the holes 537 may act as a rotation resistance to prevent the relative rotation between the support 540 and the valve spring 530. The hole filling portion 541*d* may connect the first portion 541*a* to the second portion 541*b* at a position spaced apart from the third portion 541*c*.

A plurality of holes 537 spaced apart in a circumferential direction of the outer rim 531 may be defined in the outer rim 531 so as to effectively prevent the relative rotation between the support 540 and the valve spring 530. The holes 537 may be defined at points spaced apart inward at an outer edge of the outer rim 531 so as to effectively prevent the rotation of the support 540.

The holes 537 may be defined at points spaced apart from the elastic slots 536 so as to effectively prevent the rotation of the support 540. The plurality of holes 537 may be defined between connection part start points 535*a* adjacent in the circumferential direction of the outer rim 531 so as to effectively prevent the rotation of the support 540.

As the support 540 includes the slot 544 having the same shape as the stress concentration reduction slot 536*a*, a width of the slot 544 may be narrowest in the support 540. Therefore, at least one of the plurality of holes 537 may be disposed or provided adjacent to the connection part start point 535*a* or the stress concentration reduction slot 536*a* so as to prevent damage to the portion where the slot 544 is defined in the support 540.

As described above, the hole filling portion 541*d* may prevent the damage to an edge portion of the support 540 in which the slot 544 is formed in the support 540.

One or more inner protrusions 548 may be formed on an inner circumferential surface of the support 540 so as to prevent shrinkage in an outer edge surface of the support 540, that is, the third portion 541*c*, in the process of insert-injection-molding the support 540. One or more grooves may be formed in a mold for forming the support 540. Thus, the molding liquid may fill the one or more grooves. In this case, when the support 540 shrinks in the process of cooling the molding liquid, the one or more inner protrusions 548 formed by filling the one or more grooves with the molding liquid hinders the shrinkage of the support 540 to prevent deformation of the support 540. On the other hand, the one or more inner protrusions 548 may be formed on inner circumferential surfaces of the first portion 541*a* and the second portion 541*b* of the support 540. In order to effectively prevent the shrinkage of the support 540, the plurality of inner protrusions 548 may be disposed or provided spaced apart in the circumferential direction of the support 540.

As the thickness or width of the support 540 to be injection-molded increases, it is likely that the support 540 will shrink. In particular, it is likely that the shrinkage phenomenon will occur on the inner circumferential surface or the outer circumferential surface of the support 540 corresponding to the position of the hole filling portion 541*d*. Therefore, each of the plurality of inner protrusions 548 may be disposed or provided on the inner circumferential surface of the support 540 at a portion corresponding to the hole filling portion 541*d* which is disposed or provided in the hole 537 of the valve spring 530.

The support 540 may further include one or more rotation prevention protrusions 542 so as to prevent the support 540 from being coupled to the discharge cover assembly 400 in a state in which the support 540 is coupled to the discharge cover assembly 400. The plurality of rotation prevention protrusions 542 may extend in the radial direction of the support 540. For example, each of the plurality of rotation prevention protrusions 542 may extend outward from the third portion 541*c*. The plurality of rotation prevention protrusions 542 may be disposed or provided spaced apart in the circumferential direction of the support 540.

The discharge cover 405 may include an accommodation part or portion 410 that accommodates the support 540. The accommodation part 410 may include a protrusion accommodation groove 412 capable of accommodating the plurality of rotation prevention protrusions 542.

The discharge cover 405 may include a recess part or recess 414 which may be recessed in a direction far away from the support 540 (or the discharge valve 510) in the accommodation part 410 so as to form the first space part 401*a*.

A stopper 416 may protrude from the recess part 414 so as to limit the movement of the discharge valve 510 when the discharge valve 510 is moved toward the recess part 414 by the deformation of the valve spring 530. The stopper 416 may come into contact with a coupling part 512 of the discharge valve 510. The stopper 416 may protrude from a center of the recess part 414 in a direction approaching the discharge valve 510. The plurality of discharge holes 405*a* may be defined at points of the recess part 414 spaced apart outward from the stopper 416.

Before the discharge valve assembly 500 is coupled to the discharge cover 405, the gasket 550 may be first coupled to the accommodation part 410 of the discharge cover 405. In the gasket 550, one or more ring-shaped rotation prevention protrusions 555 may protrude from the gasket 550 so as to prevent rotation in a state of being seated on the accommodation part 410. The one or more rotation prevention protrusions 555 may be accommodated into the protrusion accommodation groove 412 of the discharge cover 405.

According to this embodiment, as the rotation prevention protrusion of the gasket 550 and the rotation prevention protrusion of the support 540 are accommodated into one protrusion accommodation groove 412, the structure of the discharge cover 405 is simplified.

Figure 12:
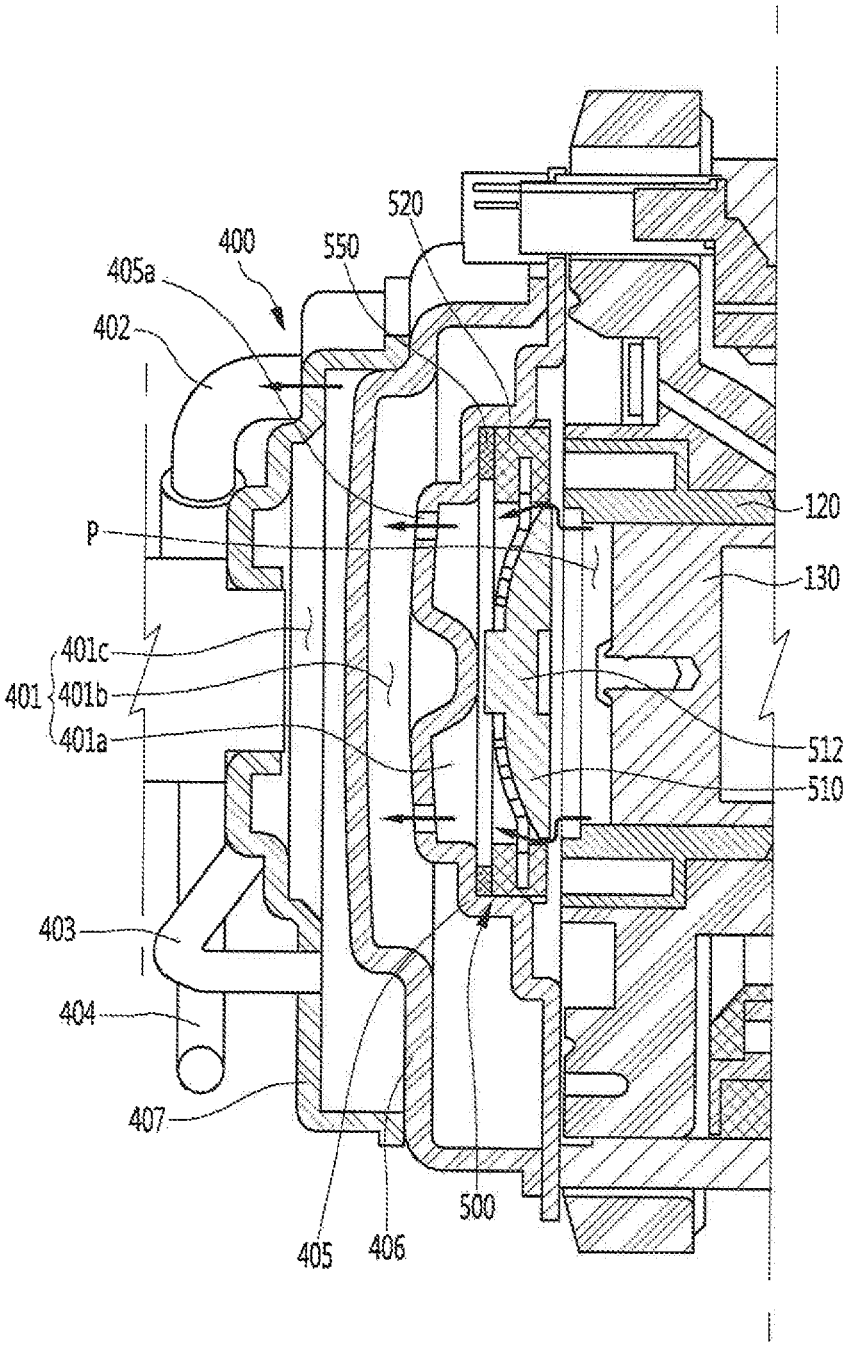
FIG. 12 is a cross-sectional view illustrating a state in which a refrigerant flows in the linear compressor according to an embodiment.

FIG. 12 is a cross-sectional view illustrating a state in which the refrigerant flows in the linear compressor according to an embodiment. The flow of the refrigerant in the linear compressor 10 according to an embodiment will be described with reference to FIGS. 4 and 12.

First, the refrigerant suctioned into the shell 101 through the suction pipe 104 may flow into the piston 130 via the suction muffler 150. At this time, when the motor 140 is driven, the piston 130 may linearly reciprocate in the axial direction.

When the suction valve 135 coupled to the front side of the piston 130 is opened, the refrigerant may be introduced and compressed in the compression space P. When the discharge valve 510 is opened, the compressed refrigerant may flow into the discharge space 401 of the discharge cover 405.

At this time, as the discharge valve 510 is coupled to the inner rim 533 of the valve spring 530, the inner rim 533 of the discharge valve 510 may move in a direction far away from the piston 130. Accordingly, when the discharge valve 510 moves in a direction far away from the piston 130, a gap may be formed between the discharge valve 510 and the cylinder 120. The refrigerant of the compression space P may be discharged to the discharge space 401 through the gap.

The refrigerant may flow into the first space part 401*a* in the compression space P, and the refrigerant flowing into the first space part 401*a* may be moved to the second space part 401*b* through the discharge hole 405*a* of the discharge cover 405. The refrigerant moving to the second space part 401*b* may be moved to the third space part 401*c* through the connection pipe 403. The refrigerant moved to the third space part 401*c* may be discharged to the outside of the linear compressor 10 through the cover pipe 402, the loop pipe 404, and the discharge pipe 105.

Embodiments disclosed herein provide a linear compressor in which relative rotation between a valve spring and a support supporting the valve spring may be prevented. Embodiments disclosed herein further provide a linear compressor in which rotation of a support with respect to a discharge cover may be prevented. Embodiments disclosed herein also provide a linear compressor in which rotation of a gasket coupled to a discharge cover may be prevented.

Embodiments disclosed herein provide linear compressor that may include a shell; a cylinder accommodated in the shell and defining a compression space for a refrigerant; a frame to which the cylinder may be fixed; a piston that reciprocates within the cylinder in an axial direction and compresses a refrigerant supplied to the compression space; a discharge valve that discharges the refrigerant compressed in the compression space; a discharge cover coupled to the frame and defining a discharge space in which the refrigerant discharged from the compression space by an opening of the discharge valve may be collected; a valve spring that supports the discharge valve; and a support integrally formed with the valve spring by insert injection molding and coupled to the discharge cover. The valve spring may define one or more holes filled with a molding liquid for forming the support in the insert injection molding of the support.

The valve spring may include a plate spring. The plate spring may include an outer rim; an inner rim disposed or provided in an inner region of the outer rim; and a plurality of connection parts or portion that connects the outer rim to the inner rim, and the support may surround the outer rim.

The support may include a first portion that comes into contact with or contacts a first surface of the outer rim; a second portion that comes into contact with or contacts a second surface which is opposite to the first surface of the outer rim; a third portion that connects the first portion to the second portion and comes into contact with or contacts an outer circumferential surface of the outer rim; and a plurality of hole filling portions that passes through the plurality of holes and connects the first portion to the second portion. The plurality of hole filling portions may be spaced apart from the third portion in a central direction of the support.

The plurality of connection parts may be spaced a predetermined distance from each other to define a plurality of elastic slots, and the plurality of holes may be defined in the outer rim. Each of the plurality of elastic slots may include an inner end defined in an outer edge of the inner rim, and an outer end defined in an inner edge of the outer rim. A stress concentration reduction slot that reduces stress concentration may be defined at the outer end.

The plurality of holes may be defined at points spaced apart from the stress concentration reduction slot. The plurality of holes may be disposed or provided spaced apart each other in a circumferential direction of the valve spring.

A slot recessed in a same shape as the stress concentration reduction slot may be defined at a point of the support corresponding to a position at which the stress concentration reduction slot is defined.

The plurality of holes may be disposed or provided spaced apart in a circumferential direction of the outer rim. The plurality of holes may be defined at positions adjacent to start points of the plurality of connection parts.

The linear compressor may further include a plurality of inner protrusions that protrudes from an inner circumferential surface of the support to prevent shrinkage of an outer circumferential surface of the support. The plurality of inner protrusions may protrude from points corresponding to points where the plurality of holes are defined.

The linear compressor may further include a plurality of rotation prevention protrusions that protrudes from an outer circumferential surface of the support; an accommodation part or portion formed in the discharge cover to accommodate the support; and a plurality of protrusion accommodation grooves recessed on an outer circumferential surface of the accommodation part to accommodate the plurality of rotation prevention protrusion. The linear compressor may include a gasket disposed or provided on a front surface of the support and seated on the accommodation part. The linear compressor may also include a plurality of rotation prevention protrusions that protrudes from an outer circumferential surface of the gasket and accommodated into the protrusion accommodation groove.

According to embodiments disclosed herein, as the hole for rotation prevention may be formed in the valve spring, it is possible to prevent the support from being relatively rotated with respect to the valve spring after the support is insert-injection-molded to the valve spring. Further, as the rotation prevention protrusion is formed on the outer circumferential surface of the support, it is possible to prevent the support from being relatively rotated with respect to the discharge cover in a state in which the support is coupled to the discharge cover. Furthermore, the rotation prevention protrusion of the gasket and the rotation prevention protrusion of the support may be accommodated into one protrusion accommodation groove, the structure of the discharge cover may be simplified. The inner protrusion may be formed considering the shrinkage in the injection molding on the inner circumferential surface of the support The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell;

a cylinder accommodated in the shell and defining a compression space for a refrigerant;

a frame to which the cylinder is fixed;

a piston that reciprocates within the cylinder in an axial direction and compresses the refrigerant supplied to the compression space;

a discharge valve that discharges the refrigerant compressed in the compression space;

a discharge cover coupled to the frame and defining a discharge space in which the refrigerant discharged from the compression space by opening of the discharge valve is collected;

a valve spring that supports the discharge valve;

a support integrally formed with the valve spring, wherein the support includes a plurality of first rotation prevention protrusions that protrude from an outer circumferential surface thereof, wherein each of the plurality of first rotation prevention protrusions is disposed spaced apart in a circumferential direction of the support, wherein the discharge cover includes:

an accommodation portion formed inside thereof to accommodate the support; and a plurality of protrusion accommodation grooves recessed outwardly from the accommodation portion to accommodate the plurality of first rotation prevention protrusions, wherein each of the plurality of protrusion accommodation grooves is formed in a shape corresponding to each of the plurality of first rotation prevention protrusions at positions corresponding to each of the plurality of first rotation prevention protrusions; and a gasket provided at a front surface of the support and seated on the accommodation portion, and wherein the gasket includes a plurality of second rotation prevention protrusions that protrude from an outer circumferential surface of the gasket and is accommodated into the plurality of protrusion accommodation grooves.

2. The linear compressor according to claim 1, wherein the valve spring includes a plate spring, wherein the plate spring includes:

an outer rim having a plurality of holes configured to be filled with a molding liquid used to form the support;

an inner rim provided in an inner region of the outer rim; and a plurality of connection portions that connects the outer rim to the inner rim, and wherein the support is configured to surround the outer rim.

3. The linear compressor according to claim 2, wherein the support includes:

a first portion that contacts a first surface of the outer rim;

a second portion that contacts a second surface, which is opposite to the first surface, of the outer rim;

a third portion that connects the first portion to the second portion and contacts with an outer circumferential surface of the outer rim; and a plurality of hole filling portions that passes through the plurality of holes and connects the first portion to the second portion, wherein the plurality of hole filling portions is spaced apart from the third portion in a central direction of the support.

4. The linear compressor according to claim 2, wherein the plurality of connection portions are spaced a predetermined distance from each other to define a plurality of elastic slots, and the plurality of holes are defined in the outer rim.

5. The linear compressor according to claim 4, wherein each of the plurality of elastic slots includes:

an inner end defined in an outer edge of the inner rim; and an outer end defined in an inner edge of the outer rim, wherein a stress concentration reduction slot that reduces a stress concentration is defined at the outer end.

6. The linear compressor according to claim 5, wherein the plurality of holes are defined at points spaced apart from the stress concentration reduction slot.

7. The linear compressor according to claim 6, wherein the plurality of holes are spaced apart from each other in a circumferential direction of the valve spring.

8. The linear compressor according to claim 5, wherein a slot recessed in a same shape as the stress concentration reduction slot is defined at a point of the support corresponding to a position at which the stress concentration reduction slot is defined.

9. The linear compressor according to claim 2, wherein the plurality of holes are spaced apart from each other in a circumferential direction of the outer rim.

10. The linear compressor according to claim 2, wherein the plurality of holes are defined at positions adjacent to start points of the plurality of connection portions.

11. The linear compressor according to claim 2, further including a plurality of inner protrusions that protrudes from an inner circumferential surface of the support to prevent shrinkage of the outer circumferential surface of the support.

12. The linear compressor according to claim 11, wherein the plurality of inner protrusions protrude from points corresponding to points at which the plurality of holes are defined.

* * * * *